United States Patent [19]

Gritsuk et al.

[11] 4,154,175

[45] May 15, 1979

[54] COOLER FOR A SHAFT FURNACE

[76] Inventors: Lev D. Gritsuk, ulitsa Kombainovskaya, 13, kv. 3; Anatoly S. Gorbik, prospekt Lenina, 24, kv. 31, both of Kharkov; Vladimir M. Antonov, ulitsa Goroshnikova, 66, kv. 156, Nizhny Tagil; Leonid D. Golod, prospekt Pravdy, 5, kv. 84, Kharkov; Evgeny G. Belkin, ulitsa Svetlaya, 19, kv. 156, Kharkov; Mikhail G. Gorelik, ulitsa Ivanova, 24, kv. 12, Kharkov; Vladimir A. Karypov, pereulok Sverdlova, 2, kv. 8, Kharkov; Kornei G. Dashkevich, ulitsa Individualnaya, 7, kv. 69, Nizhny Tagil; Yakov I. Gorodetsky, prospekt Gagarina, 25, kv. 32, Kharkov, all of U.S.S.R.

[21] Appl. No.: 869,455

[22] Filed: Jan. 16, 1978

[51] Int. Cl.[2] ..... F22B 1/00; F22B 37/36

[52] U.S. Cl. ..... 122/6 R; 122/7 A

[58] Field of Search ..... 122/6 R, 6 A, 7 R, 7 A

[56] References Cited

U.S. PATENT DOCUMENTS

| | | | |
|---|---|---|---|
| 3,212,476 | 10/1965 | Markow et al. | 122/7 |
| 3,750,629 | 8/1973 | Cramer et al. | 122/6 |
| 3,820,509 | 6/1974 | Van Der Vliet | 122/6 |
| 3,938,789 | 2/1976 | Richards | 122/7 |

*Primary Examiner*—Kenneth W. Sprague

*Attorney, Agent, or Firm*—Lackenbach, Lilling & Siegel

[57] ABSTRACT

A cooler for a shaft furnace comprises a metal plate for protecting the furnace walls from the heat effect arranged in the way of heat flow and a means for cooling said plate. The plate is made in the form of metal pipes filled with a coolant and sealed at the ends thereof. The coolant-filled ends of the pipes are rigidly fixed to the plate, and the coolant-free ends of said pipes are mounted within a cooling chamber with the coolant circulating therethrough. The cooling chamber is arranged exteriorly of the furnace wall. The coolant-free ends of the pipes are disposed slightly above those filled with the coolant. The plate is formed of two layers, namely, a high-heat-conducting layer and a low-heat-conducting one, the former facing the furnace working space and the latter being presented to the furnace wall. The interfacial plane of the layers is parallel to the longitudinal axis of the pipes.

The present invention can be advantageously used for the protection of blast-furnace shells.

6 Claims, 4 Drawing Figures

COOLER FOR A SHAFT FURNACE

BACKGROUND OF THE INVENTION

The present invention relates to cooling arrangements for protecting the walls of metallurgical furnaces from heat, and more particularly to shaft-furnace coolers.

The invention can be advantageously applied for the protection of blast-furnace shells.

Because of elevated temperatures created in the working space of a blast furnace, the shell thereof is subjected to severe heat. Therefore, special arrangements are called for to insure mechanical strength of such shells and to protect them from heat loads. The arrangements in question are plate coolers which are usually mounted on the furnace shell at the side of the furnace working space.

It is modern practice to intensify the blast-furnace process by raising the blast temperature, increasing the amount of oxygen contained in the blast, or else by building up pressure in the furnace space. The above factors are detrimental to the operation of heat-protecting arrangements, placing more stringent requirements upon their ability to resist heat.

There are known in the art plate coolers which comprise a cast-iron plate with built-in steel pipes whose open ends extend beyond the plate and through the furnace shell. The pipes are connected through said ends with the furnace cooling circuit through which circulates a coolant, such as industrial or chemically treated water, or vapor-water mixture.

In the course of the blast-furnace operation, the plate is exposed to heat loads which vary timewise. As a result, the plate tends to change its geometrical dimensions, expanding and contracting. The plate expansion and shrinkage adversely affect the pipes which are rigidly connected therewith. The process of manufacturing coolers is such that it causes embrittlement of steel pipes which are subjected to carbonization in the process of casting molten iron therein. The ends of the pipes extending through the furnace shell are usually welded thereto. With the iron plate acting upon said pipes, there are created in the pipes periodically variable pressures which bring about their destruction. As a result, the coolant passing from the furnace cooling circuit penetrates through the damaged pipe into the furnace working space. This calls for higher fuel input per unit of production because of the heat losses required for the evaporation of the escaped coolant. In some cases, the penetration of considerable amount of coolant to the furnace may even disrupt the furnace operating process.

At present, due to the lack of reliable and prompt trouble-shooting techniques, it takes considerable time and human effort to spot and disconnect the damaged pipe. The attending personnel involved in such operation are compelled to work under conditions of severe gas contamination and high temperatures.

It is deemed necessary to point out still another disadvantage of the hereinbefore described coolers. There is provided in the furnace cooling circuit a plurality of coolers which are connected thereto, and with gravity circulation of the coolant. This type of coolant circulation depends for its rate on the average heat load acting on the coolers. With the lining being broken away from the surface of the cooler plate, the latter is exposed to severe heating which can be eliminated only by increasing the rate of vapor-water mixture circulation through the pipes intended for cooling the plate. As mentioned above, however, the rate of circulation depends solely on the average heat load acting on the group of coolers, which practically remains constant. Therefore, the increased amount of heat effecting a separate plate results in greater amount of vapor in the pipes cooling this plate, which, in turn, causes its overheating and fusion.

For the purpose of improving the cooling of the cooler plate during a sudden increase of the flow rate of heat effecting said cooler and to eliminate the possibility of water penetration into a metallurgical furnace, there has been developed a cooler comprising a plate with pipes whose ends at one side thereof are built into said plate. The pipes are filled with a coolant and sealed. The other ends of the pipes, which are mounted higher than those filled with water, extend beyond the plate and pass through the furnace shell into a cooling chamber where they are fixed. Circulating in the cooling chamber is a coolant. The cooling chamber is arranged exteriorly of the furnace and connected to the cooling circuit thereof.

The improved cooling of the plate of each separate cooler has been accomplished by way of sealing the ends of the cooler plate pipes, whereby each pipe is provided with its own circuit wherein the vapor-water mixture circulation is determined by the heat loads acting on such circuit. The rate of vapor-water mixture circulation in the plate-cooling pipes increases with the heat load acting on the plate, thereby providing for reliable cooling of said plate.

The use of such cooler practically eliminates coolant penetration into the furnace in case of damage to the sealed pipe, since there is but a negligible amount of coolant contained therein, water with the furnace cooling circuit, wherein circulates and is separated from the interior of the damaged pipe by the wall of the latter. This being the cooler construction, the pipe is surrounded with the cast-iron plate, having therefore, its entire surface exposed to heat. It happens that certain heat flows cause abundant formation of vapor in the part of the pipe which is fixed in the plate, and the condensate, formed in the free part of the pipe due to condensation of vapor passing thereinto through a cooling chamber, is prevented from descending to the lower part of the pipe. Thus, the water from the part of the pipe fixed in the plate is rushed to the upper part of the pipe. This results in the overheating of the pipe and plate walls because of the absence of the heat outlet leading to the furnace cooling circuit, and the destruction of the cooler thus becomes inevitable.

To eliminate the above-mentioned disadvantage, there has been proposed a cooler for a metallurgical shaft furnace, comprising a plate with built-in pipes whose ends at one side thereof are filled with a coolant and sealed. The other ends of said pipes are disposed above those filled with the coolant and extend beyond the plate and through the furnace shell into a cooling chamber to be fixed therein, said chamber being connected to the furnace cooling circuit with a coolant circulating therethrough. Fitted into each said pipe is a pipe-insert with a diameter substantially less than that of the main pipe, so that open ends of the inserted pipe have no contact with closed ends of the pipes, the generatrix of the inserted pipe coming in contact with that of the pipe facing the furnace shell.

The heat removed from the plate is used to heat up the water in the sealed pipe. The resultant vapor-water mixture rises to the coolant-free end of the pipe wherein the vapor is condensed on the pipe wall, cooled with the coolant flowing through the cooling chamber and circulates within the furnace cooling circuit, and then drains down through the inserted pipe. In such a manner the coolant flow is separated into two flows, namely: the vapor-water mixture flow rising to the water-free end of the pipe, and the condensate flow passing down to the portion of the pipe in contact with the plate. The cooler was thus enabled to function faultlessly in the conditions of severe heat flowing out of the furnace working space; this being the advantage over the previously described cooler.

However, the hereinabove described cooler is complicated in construction due to the difficulty of fitting smaller-diameter pipes into the plate-cooling pipes, the former requiring complex configuration which resembles that of the latter.

It is therefore an object of the present invention to improve operating reliability of a shaft-furnace cooler by means of providing reliable cooling of the cooler plate exposed to heat evolved in metallurgical furnaces.

Another object of the invention is to increase the furnace campaign by means of enhancing operating durability of coolers due to improving the heat resistance of their plates.

Still another object of the invention is to reduce the cooler weight.

SUMMARY OF THE INVENTION

These and other objects of the invention are accomplished by the provision of a cooler for metallurgical furnaces, comprising a plate adapted to protect the furnace walls against the heat effect and arranged in the way of heat flow, and a means for cooling said plate, made in the form of metal pipes filled with a coolant and sealed at ends thereof, the coolant-containing ends of said pipes being rigidly fixed in the plate while the coolant-free ends thereof are mounted in a cooling chamber, with the coolant circulating therethrough, arranged exteriorly of the furnace wall body. The coolant-free ends of the pipes being slightly above those containing the coolant, wherein, according to the invention, the plate is formed of two layers, namely, a high-heat-conducting layer and a low-heat-conducting layer, the former facing the furnace working space and the latter being presented to the furnace wall body, and the interfacial plane of said layers being parallel to the longitudinal axis of said pipes.

Such constructional arrangement of the cooler plate makes it possible to create in each plate-cooling pipe a circulating flow of a definite structure.

Owing to the fact that the plate is made of two layers, with the high-heat-conducting layer facing the furnace working space and the low-heat-conducting one being presented to the furnace wall body, the interfacial plane of said layers running parallel to the longitudinal axis of the plate-cooling pipes, there occurs in each of said pipes a separation of the coolant flow into a vapor-water mixture flow and that of water. The aforesaid separation takes place due to non-unifrom heating of the surfaces of said pipes around their periphery. The part of the pipe which faces the furnace working space and in contact with the plate high-heat-conducting layer is heated more than that in contact with the plate layer made of a low-heat-conducting material. In the part of the pipe interior passage which is narrowed by the overheated walls thereof, a vigorous vapor-forming process develops and is accompanied by an ascending flow of vapor-water mixture. In the other part of the pipe interior passage a flow of water freely passes down, i.e. natural or gravity circulation of coolant is formed within said pipe. Thus, favorable operating conditions are created for the plate-cooling pipes and for the cooler as a whole. The circulating conditions in the pipes can be feasibly maintained within a definite rate of heat flow, required for heating the plate and pipes; but an excessive rate of heat flow will upset the aforedescribed structure of the coolant circulation in the pipes since an upwardly moving flow of vapor-water mixture takes up the entire interior space of the pipe, blocking the downward passage of water towards the end of the pipe fixed in the plate, thereby disrupting normal conditions of cooling the plate.

The above-mentioned problem finds its solution in that each pipe is provided with a partition extending short of the closed ends of the pipe and in parallel with the longitudinal axis of the pipe, said partition defining two cavities, one of which is a heat-absorbing cavity facing the high-heat-conducting layer, the partition plane being substantially coincident with the interfacial plane of the two plate layers.

Such an arrangement of the partitions in the cooler plate-cooling pipes is required to enable mechanical separation of the ascending flow of vapor-water mixture formed in the part of the pipe adjacent to the high-heat-conducting layer, and the downwardly passing flow of water formed of the condensed vapor. Thus, the upwardly moving flow will not impede the downward passage of water to the pipe end fixed in the plate. This allows for reliable cooling of the plate and affords protection to the furnace wall body against the heat effect.

Since the pipes with partitions therein are simple to manufacture, the latter are secured in the pipe longitudinal central plane. Such an arrangement of the partition is the best possible, with the latter being equal in width to the diameter of the pipe into which it is inserted.

The passageway of the pipe is thus divided by the partition into cavities equal in cross section, which, however, is undesirable from the point of view of hydraulic resistance to the ascending flow of vapor-water mixture in the cavity adjacent the high-heat-conducting layer of the plate. When the heat load acting on the plate and pipes becomes excessive, a great amount of vapor is formed in the cavity adjacent the high-heat-conducting layer, and the cavity is small enough in cross section to enable the escape of vapor. This being the case, directed coolant circulation in the pipes is disrupted and the cooling of the plate deteriorates.

The above disadvantage is eliminated by displacing the partition plane from the longitudinal axis or central plane of the pipe towards the furnace wall body by 0.1 to 0.3 of the pipe inside diameter.

Such mounting of the partitions in the plate-cooling pipes bring about an increase in the cross sectional area of the pipe cavity adjacent to the high heat-conducting layer of the plate, i.e. hydraulic resistance to the ascending flow of vapor-water mixture is reduced. This, in turn, results in reliable circulation of coolant in the pipes.

Such an arrangement of the partitions makes for the removal of specific heat loads on the order of $30\times10^6$(ccal/m$^2$h) through the cross section area of the pipe cavity adjacent to the high-heat-conducting layer without upsetting the coolant circulation in the pipe.

The high-heat-conducting layer of the two-layer plate is preferably manufactured from such material as heat-resistant iron, and the low heat-conducting layer from heat-resistant concrete. Since the specific weight of concrete is considerably less than that of cast iron, the cooler plate is reduced in weight.

To enhance heat resistance of the high-heat-conducting layer, the latter is formed of individual bars which are mounted on the pipes for free movement during thermal expansion along the axes of the pipes.

Due to the fact that the cooler in accordance with the invention is constructed so that the plate thereof consists of two layers, namely, a high-heat-conducting layer and a low heat-conducting one, and the pipes are provided with partitions, it is possible to considerably expand the operating range of heat loads which fail to affect a cooler plate having cooling protection by pipes, and thus to heat resistance of a cooler may be enhanced. It has been found feasible to make use of the pipes for cooling purposes of metallurgical installations, which are sealed at their ends and filled with a coolant, the ends of said pipes at one side being rigidly fixed in the plate and extending at the other side beyond the plate and through the furnace wall body into a cooling chamber to be fixed therein. This allows for removing severe heat fluxes which arise in individual coolers independently of moderate heat fluxes; it also precludes the penetration of water into the furnace working space in case of any damage to a pipe; and makes it possible to reduce the weight of coolers adapted for use on metallurgical installations.

BRIEF DESCRIPTION OF THE DRAWINGS

These and other objects and features of the invention will become more apparent from a specific embodiment thereof, taken in conjunction with the accompanying drawings. In the drawings.

DESCRIPTION OF THE PREFERRED EMBODIMENT

Figure 1:
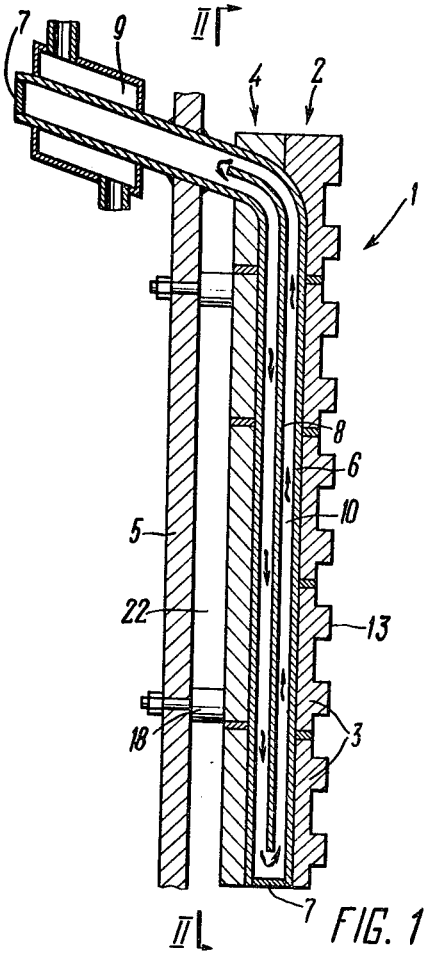
FIG. 1 is a longitudinal cross-sectional view of a cooler according to the invention.
Figure 2:
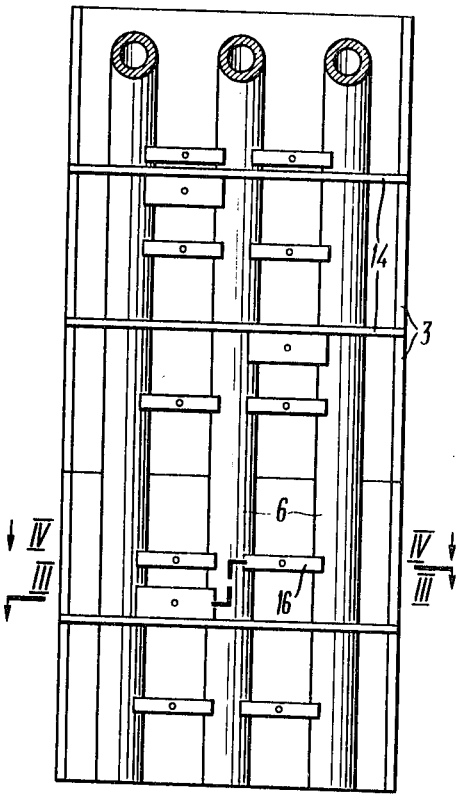
FIG. 2 is a cross-sectional view taken along line II—II of FIG. 1; a low-heat-conducting layer is not shown.

In the embodiment, a cooler for a blast furnace comprises a two-layer plate 1 (see FIG. 1), layer 2 facing the furnace inner space is formed of individual cast-iron bars 3 which extend horizontally for a length exceeding their height and the other layer 4 thereof being presented to a furnace wall 5 and formed of heat-resistant concrete. The cooler plate 1 likewise incorporates at least two pipes 6, such as shown in FIG. 2, which pipes are partially filled with a coolant and sealed at the ends thereof with plugs 7, such as shown in FIG. 1. Each of the pipes are provided with a partition 8 extending short of the plugs 7. The coolant-filled end of the pipe 6 is mounted in the plate 1, and the coolant-free end of said pipe 6 being mounted within a cooling chamber 9 arranged exteriorly of the furnace wall 5 and connected to the furnace cooling circuit (not shown).

Figure 3:
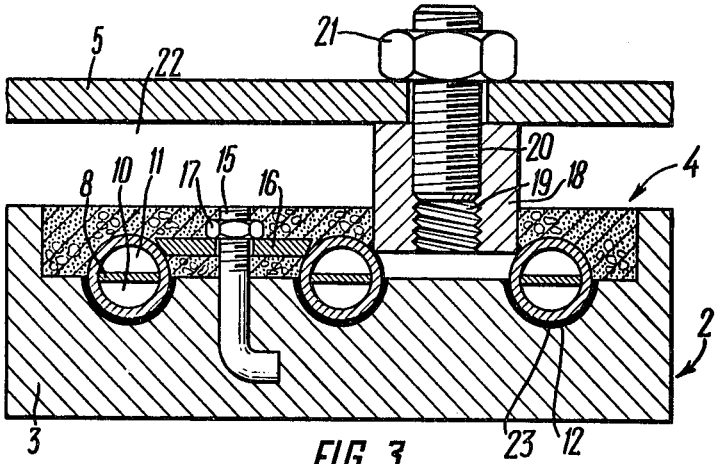
FIG. 3 is a cross-sectional view taken along line III—III of FIG. 2.

The partition 8 divides the interior of the pipe 6 into two cavities, one of which is a heat-absorbing cavity 10 adjacent to the high heat-conducting layer 2, and the other cavity 11 being adjacent to the low heat-conducting layer 4 formed of heat-resistant concrete. On the surface of each bar 3, presented to the furnace wall 5, is a recess such as shown at 12 in FIG. 3, adapted to receive the pipes 6 therein; the surfaces of said bars presented to the furnace working space being formed with ribs 13, such as shown in FIG. 1. The pipes 6 are interconnected by means of cleats 14, shown in FIG. 2. The interconnected pipes 6 are accommodated in the recesses 12 fitted in the bars 3. Each of the bars 3 is fixed by means of pins 15, cast-in in the spaces between the recesses 12, on the pipes 6 with the aid of plates, such as plate springs 16 which are secured on said pipes 6 by screw nuts 17. To enable mounting the plate 1 on the furnace wall body 5, the pipes 6 have welded thereto lugs 18, such as shown in FIG. 3, fitted with threaded holes 19 adapted to receive studs 20 therein. The described cooler is secured on the furnace wall body 5 by means of the studs 20 and screw nuts 21. All the coolers are mounted on the furnace wall body 5 so that a gap 22 is provided for a heat-insulating material to be placed therein, the size of said gap being determined by the height of the lug 18. To facilitate heat transfer from the bars 3 to the pipes 6, the recesses 12 accommodate a layer 23 of heat-conducting material.

The number of the bars 3 which make up the metal layer 2 of the plate 1 is determined by the cooler height and width parameters so that the height-width ratio of the bar 3 is within the range of 2 to 4.

The number of the pipes 6 provided in the cooler is determined by the width of the plate 1, as well as by the heat load acting on the cooler used in a given metallurgical installation.

The diameter of the pipe 6 is selected in accordance with the rigidity of the cooler construction and the heat loads acting thereupon.

The provision of the partition 8 in the pipe 6, as well as its arrangement therein, is governed by the heat loads acting on the cooler and, consequently, by the heat loads transferred through the cross-section of the pipe 6. The cast-iron bars 3 of each cooler are heated with the heat of the furnace working space, transferring the absorbed heat through the heat-conducting layer 23 to the walls of the cooling pipes 6. The transferred heat causes boiling of water in the heat-absorbing cavities 10 of the pipes 6, with the resultant ascending flow of vapor-water mixture being formed in each of said cavities. The heat passing up to the pipes 6 from the side of the concrete-made layer 4 is considerably less in amount due to the lower heat conductivity of the heat-resistant concrete as compared to that of metal. Therefore, the hydraulic resistance, created in the cavity 11 of the pipe 6, by the downwardly passing flow of condensate formed in the coolant-free end of the pipe 6 cooled by the coolant flowing through the chamber 9, is very small. Thus, a directed circulation of the vapor-water mixture and water originates in the interior of the pipe 6, i.e. in the cavity 10 of the pipe 6 a flow of vapor-water mixture rises to the fluid-free end of the pipe 6 wherein vapor is separated from water to be thereby condensed, the water draining down through the cavity 11 to the lower end of the pipe 6. In this manner reliable cooling is provided for the walls of the pipes 6 and bars 3, and the cooler thus fulfills its function of affording protection to the walls of the furnaces against overheating and destruction.

When subjected to heating, the bars 3 tend to increase in dimension, freely elongating in the direction parallel to the axes of the pipes 6, with the fixture elements 15, 16 and 17 permitting such elongation. As a result, the displacement of the bars 3 causes no mechanical strains in the pipes 6.

Figure 4:
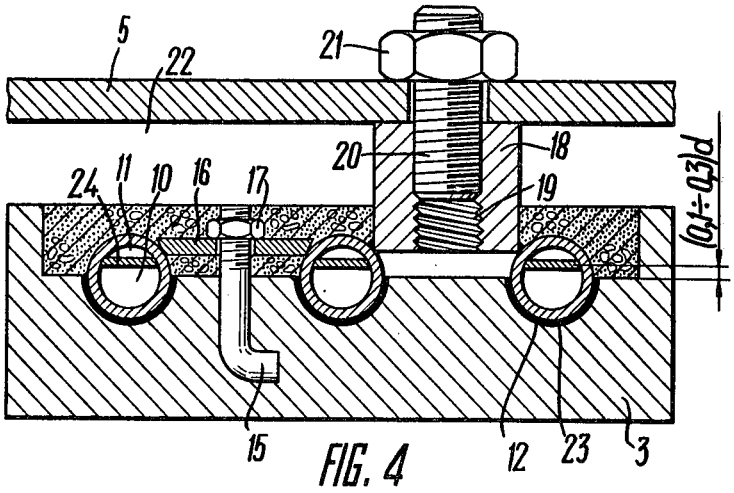
FIG. 4 is a cross-sectional view taken along line IV—IV, wherein a partition is constructed.

With heat fluxes passing up at a higher rate, which fluxes are removed through the cavity 10 of the pipe 6, it is advisable to install the partition 24, such as shown in FIG. 4, in the plane offset from the longitudinal central plane of the pipe towards the layer 4 by 0.1 to 0.3 of the pipe inside diameter, which increases the cross-sectional area of the cavity 10 and, consequently, decreases hydraulic resistance to the ascending flow of vapor-water mixture in the cavity 10.

Therefore, the cooler construction according to the invention improves operational reliability of the cooling system utilized on metallurgical installations by enhancing the heat resistance of cooler plates;

provides for autonomous operation of each cooling pipe, which permits removal, from the plate cooled, of vigorous heat fluxes formed in various places within the furnace;

increases the life of metallurgical furnaces;

minimizes emergency situations due to the destruction of the furnace walls;

prevents penetration of water to the furnace working space; and reduces the cooler weight by 1.5 time.

What is claimed is:

1. A cooler for a shaft furnace, comprising: a plate adapted to protect the furnace wall body against the effect of heat flux to which it is exposed and being formed of two layers, a high-heat-conducting layer facing the furnace working space and a low-heat-conducting one presented to the furnace wall; means for cooling said plate, in the form of a plurality of metal pipes partially filled with a coolant and sealed at opposite ends thereof, the longitudinal axis of said pipes being parallel to the interfacial plane of said layers; a cooling chamber arranged exteriorly of the furnaces wall body and having a coolant circulating therethrough; the lower ends of said pipes filled with said coolant are rigidly connected to said plate; and the upper ends of said pipes which are free from said coolant, are arranged and mounted thereabove in said cooling chamber.

2. A cooler as claimed in claim 1, comprising: a plurality of individual bars forming said heat-conducting layer of said plate, each of said bars extending horizontally for a length exceeding their height; recesses adapted to accommodate said pipes and formed on the surfaces of said bars facing the furnace wall; a layer of a heat-conducting material in said recesses; elements for fixing each of said bars to said pipes being fitted in the spaces between said recesses; and members for securing said pipes to the furnace wall being welded to said pipes.

3. A cooler as claimed in claim 1, wherein heat-resistant iron is used as the material for said high-heat conducting layer, and heat-resistant concrete being used for said low-heat-conducting layer.

4. A cooler as claimed in claim 1, including a partition mounted in each of said pipes and extending short of the end of said pipe and defining two cavities, one of which being a heat-absorbing cavity adjacent to said high-heat-conducting layer, and the plane of said partition being substantially coincident with said interfacial plane of said layers.

5. A cooler as claimed in claim 4, wherein each plane of each said partition is coincident with the longitudinal central plane of each said pipe.

6. A cooler as claimed in claim 4, wherein said plane of each said partition is offset from the longitudinal axis of each said pipe towards the furnace wall body by 0.1 to 0.3 of the inside diameter of said pipe.

* * * * *